US008210910B2

(12) United States Patent
McLain

(10) Patent No.: US 8,210,910 B2
(45) Date of Patent: Jul. 3, 2012

(54) MULTI-FACETED SANDING/FINISHING TOOL

(75) Inventor: Scott S. McLain, Mukwonago, WI (US)

(73) Assignee: Lake Country Manufacturing, Inc., Hartland, WI (US)

( * ) Notice: Subject to any disclaimer, the term of this patent is extended or adjusted under 35 U.S.C. 154(b) by 897 days.

(21) Appl. No.: 12/273,012

(22) Filed: Nov. 18, 2008

(65) Prior Publication Data

US 2010/0124873 A1 May 20, 2010

(51) Int. Cl.
*B24D 15/00* (2006.01)

(52) U.S. Cl. ..... 451/524; 451/525; 451/557; 451/539; 451/461

(58) Field of Classification Search ..... 451/524, 451/525, 557, 539, 461
See application file for complete search history.

(56) References Cited

U.S. PATENT DOCUMENTS

| | | | | | |
|---|---|---|---|---|---|
| 129,103 | A | * | 7/1872 | Cliffton | 451/557 |
| 137,763 | A | * | 4/1873 | Daniels | 451/557 |
| 148,698 | A | * | 3/1874 | Higgins | 15/231 |
| 785,264 | A | * | 3/1905 | Maier | 451/461 |
| 1,067,280 | A | * | 7/1913 | Smilovetz | 451/503 |
| 1,332,101 | A | * | 2/1920 | Brown | 451/461 |
| 1,520,642 | A | * | 12/1924 | Giroux | 451/522 |
| 1,931,718 | A | * | 10/1933 | Chormann | 451/557 |
| 2,904,939 | A | * | 9/1959 | Raia | 451/491 |
| 3,034,267 | A | * | 5/1962 | Feeney | 451/492 |
| 4,189,874 | A | * | 2/1980 | Labriola | 451/461 |
| 4,249,349 | A | | 2/1981 | Rueb | |
| 4,263,755 | A | * | 4/1981 | Globus | 451/490 |
| 4,317,248 | A | | 3/1982 | Smith | |
| 4,845,901 | A | | 7/1989 | Hamlin | |
| 4,918,871 | A | * | 4/1990 | Widmann | 451/461 |
| 5,033,552 | A | * | 7/1991 | Hu | 173/217 |
| 5,040,256 | A | * | 8/1991 | Mills | 7/164 |
| 5,140,785 | A | | 8/1992 | Eleouet | |
| 5,157,879 | A | * | 10/1992 | Fletcher | 451/555 |
| 5,170,595 | A | * | 12/1992 | Wiand | 451/538 |
| 5,309,681 | A | * | 5/1994 | Cheney et al. | 451/344 |
| 5,389,032 | A | * | 2/1995 | Beardsley | 451/359 |

(Continued)

FOREIGN PATENT DOCUMENTS

DE 389344 2/1924

OTHER PUBLICATIONS

European Search Report dated Nov. 11, 2011.

*Primary Examiner* — George Nguyen
(74) *Attorney, Agent, or Firm* — Andrus, Sceales, Starke & Sawall, LLP

(57) ABSTRACT

A sanding and finishing tool is constructed from a number of interlocking sanding members configured such that the sanding and finishing tool is equipped for sanding and/or finishing jobs of varying sizes and degrees, and is further able to easily sand and/or finish in and around various sized edges, crevices and corners. The tool includes a first sanding member having a handle which can be provided with auxiliary sanding members having auxiliary sanding surfaces. The first sanding member includes a sanding surface covered by a sanding material, wherein the sanding material is removably attached to the sanding surface. The tool further includes any number of additional sanding members, such that each additional sanding member dovetails on to the last sanding member, and also includes a sanding surface and material.

23 Claims, 6 Drawing Sheets

U.S. PATENT DOCUMENTS 5,392,569 A 2/1995 Stickle
5,558,572 A 9/1996 Fletcher
6,296,558 B1 10/2001 Poole et al.
6,368,202 B1 * 4/2002 Kaiser ..... 451/548
D539,111 S * 3/2007 Cardew et al. ..... D8/91
7,186,174 B1 * 3/2007 Arnold ..... 451/524
7,311,591 B2 * 12/2007 Stubbs ..... 451/538
7,320,634 B1 * 1/2008 Minick ..... 451/344
2002/0178658 A1 12/2002 Tominaga et al.
2007/0212993 A1 9/2007 Annis
2008/0207099 A1 * 8/2008 Brown ..... 451/524
2008/0233849 A1 * 9/2008 Ali et al. ..... 451/525
2009/0104864 A1 * 4/2009 Annis ..... 451/557

* cited by examiner

MULTI-FACETED SANDING/FINISHING TOOL

FIELD OF THE INVENTION

The invention relates generally to the field of hand tools. More particularly, the invention relates to the field of hand-held sanding and finishing tools.

BACKGROUND OF THE INVENTION

Sanding and finishing tools commonly include a member with a flat surface for receiving the back side of a sheet of sandpaper and a clamp or other means for securing the sheet of sandpaper to the tool. These tools are well adapted for sanding most flat surfaces. However, problems are encountered when they are employed to sand surfaces that are confined, narrow, curved either convexly or concavely, or otherwise irregular in some respect.

One application where this is a particular problem is automotive body sanding and finishing. This problem requires current sanding and finishing tool users to have sanding and finishing tools of various sizes and shapes. This can be inconvenient and costly.

SUMMARY OF THE INVENTION

The present invention relates to a sanding and finishing tool including a number of interlocking sanding members configured such that the sanding and finishing tool is equipped for sanding and/or finishing jobs of various sizes and shapes, and is further able to easily sand and/or finish in and around various sized edges, crevices and corners. The tool of the present invention includes a first sanding member provided with a handle, wherein the handle can also include auxiliary sanding members having auxiliary sanding surfaces. The sanding member includes a sanding surface covered by a sanding material, wherein the sanding material is removably attached to the sanding surface. The tool further includes any number of additional sanding members, such that each additional sanding member dovetails on to the preceding sanding member, and also includes a sanding surface and material.

In one aspect of the invention, a sanding apparatus includes a first sanding member including a first sanding surface configured for sanding variously shaped surfaces. A second sanding member is formed with a channel and in which is received the first sanding member such that the second sanding member is removably attached to the first sanding member. When the first and second sanding members are attached, the second sanding member substantially covers the first sanding surface, and the first sanding member defines a handle.

A first sanding material is affixed to the first sanding surface such that the first sanding material substantially covers the first sanding surface. A second sanding material is affixed to the second sanding surface such that the second sanding material substantially covers the second sanding surface. Either of the first sanding material or the second sanding material is removably affixed to the first sanding surface or the second sanding surface, respectively. The first sanding material is removed from the first sanding surface before the second sanding member is coupled to the first sanding member. In a preferred embodiment, the first sanding surface and the second sanding surface are covered with a vinyl backing layer. A surface of the first sanding material is provided with a pressure sensitive adhesive which is removably joined to the vinyl backing layer on the first sanding surface. A surface of the second sanding material is provided with a pressure sensitive adhesive which is removably joined to the vinyl backing layer on the second sanding surface. In an alternative embodiment, the first sanding surface and the second sanding surface are covered with one half of a hook and loop fastener. A surface of the first sanding material is provided with the other half of a hook and loop fastener which is removably joined to the one half of a hook and loop fastener on the first sanding surface. A surface of the second sanding material is provided with one half of a hook and loop fastener which is removably joined to the other half of a hook and loop fastener on the second sanding surface.

The handle preferably has a substantially cylindrical shape and includes an auxiliary sanding member wherein the auxiliary sanding member includes an auxiliary sanding surface configured to receive an auxiliary sanding material. The auxiliary sanding member is constructed such that the auxiliary sanding surface is either circular or triangular in shape. Any of the first sanding member and the second sanding member are preferably constructed from a rubber material, and the auxiliary sanding member includes a compressible foam material. The handle includes the first sanding member having a first sanding surface. The first sanding member is configured to be removably coupled to the second sanding member such that a channel in the second sanding member is constructed to receive the first sanding member. When the second sanding member and the first sanding member are coupled, the second sanding member substantially covers the first sanding surface. When the second sanding member and the first sanding member are uncoupled, a first sanding material is affixed to the first sanding surface such that the first sanding material substantially covers the first sanding surface. The first sanding material is removably affixed to the first sanding surface. In the preferred embodiment, the first sanding surface is covered with a vinyl backing layer. A surface of the first sanding material is provided with a pressure sensitive adhesive which is removably joined to the vinyl backing layer on the first sanding surface. In an alternative embodiment, the first sanding surface is covered with one half of a hook and loop fastener. A surface of the first sanding material is provided with the other half of the hook and loop of fastener which is removably joined to the one half of a hook and loop fastener on the third sanding surface. The first sanding surface, a second sanding surface and the third sanding surface are substantially planar. The third sanding member includes a rounded end portion and an angled end portion.

In another aspect of the invention, a third sanding member includes a third sanding surface configured for sanding variously shaped surfaces. The third sanding member is formed with a channel, and the third sanding surface is provided with a third sanding material affixed thereto. A second sanding member has a second sanding surface received in the channel of the third sanding member such that the second sanding member is removably attached to the third sanding member. When the third and second sanding members are attached, the third sanding member substantially covers the second sanding surface. A first sanding member defines a handle and has a first sanding surface received in a channel of the second sanding member such that the first sanding member is removably attached to the second sanding member. When the second and first sanding members are attached, the second sanding member substantially covers the first sanding surface.

When the third and second sanding members are uncoupled, a second sanding material is affixed to the second sanding surface such that the second sanding material substantially covers a second sanding surface. When the second and first sanding members are uncoupled, a first sanding material is affixed to the first sanding surface such that the first sanding material substantially covers the first sanding surface. The second and first sanding members have substantially planar bottoms and inwardly sloping opposite end portions. The third sanding member has a substantially planar bottom, a rounded end portion and an angled end portion.

BRIEF DESCRIPTION OF THE DRAWINGS

The drawings illustrate the best mode presently contemplated in carrying out the invention.

In the drawings.

DETAILED DESCRIPTION OF THE INVENTION

Figure 1:
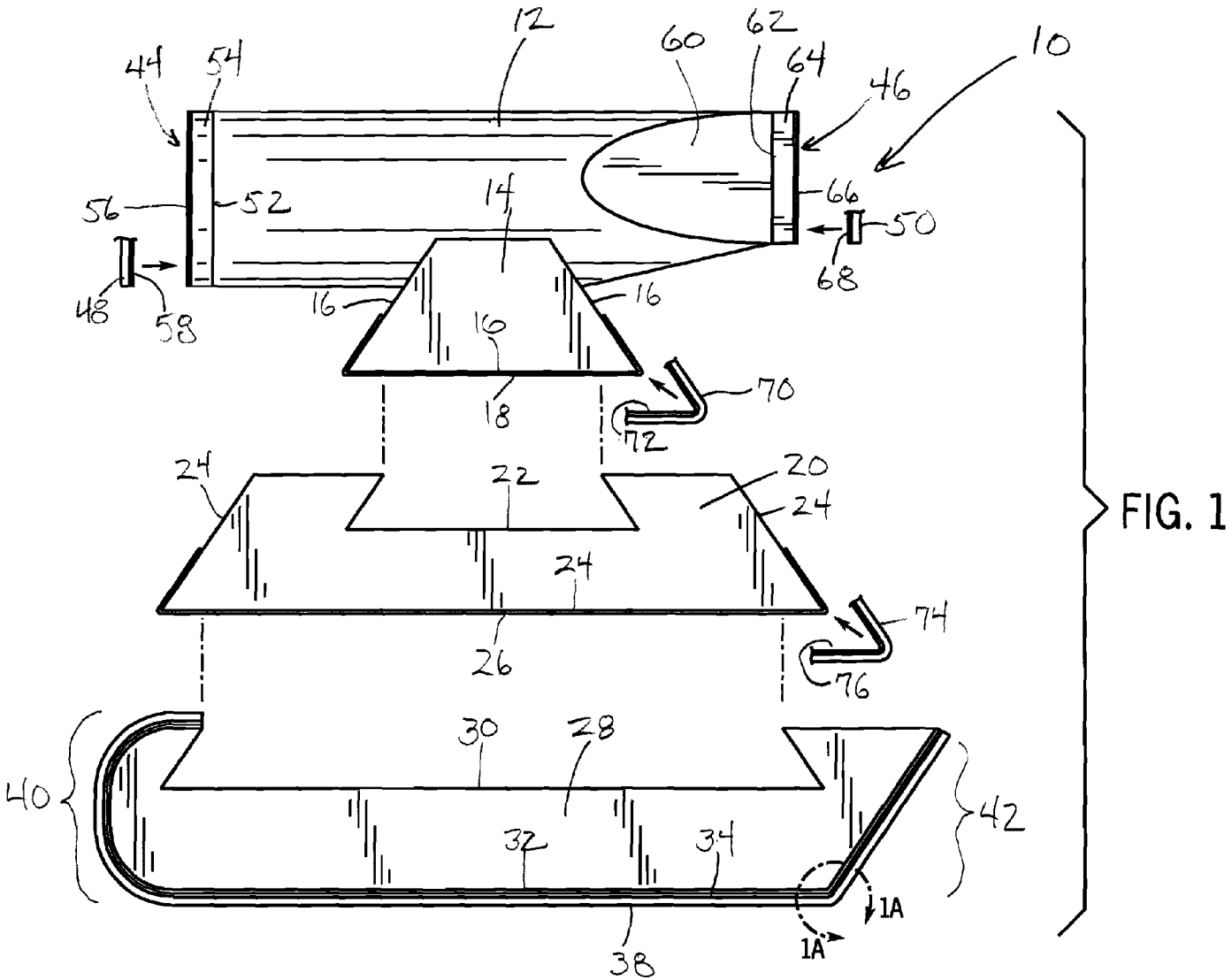
FIG. 1 illustrates an exploded side view in accordance with a preferred embodiment of the present invention.

A side view of the preferred embodiment of the present invention showing a sanding tool 10 is depicted in FIG. 1. The sanding tool 10 includes a generally cylindrical handle 12 attached to a first sanding member 14. The first sanding member 14 has a dovetail shape and includes a first sanding surface 16 covered with a first vinyl backing layer 18. A vinyl backing layer 18 runs along a substantially planar bottom of first sanding surface 16 and also extends upwardly for a distance along inwardly angled ends of the first sanding surface 16. The sanding tool 10 also includes a second sanding member 20 having a dovetail-shaped channel 22 notched into the second sanding member 20 such that the first sanding member 14 fits into the channel 22 in order to removably couple the second sanding member 20 to the first sanding member 14. The channel 22 in the second sanding member 20 is configured such that the first vinyl backing layer 18 is substantially covered by the second sanding member 20 when the second sanding member 20 is coupled to the first sanding member 14.

Figure 1A:
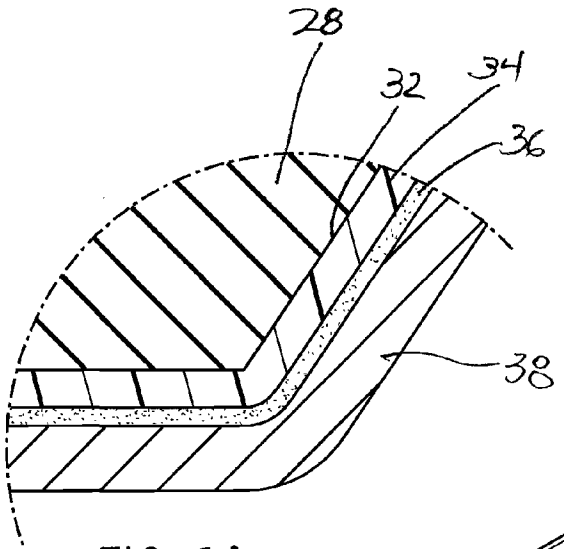
FIG. 1A is an enlarged cross-sectional view taken on line 1A-1A of FIG. 1.

Still referring to FIG. 1, the second sanding member 20 includes a second sanding surface 24 covered with a second vinyl backing layer 26. The vinyl backing layer 26 runs along a substantially planar bottom of second sanding surface 24 and also runs upwardly for a distance along inwardly angled ends of the second sanding surface 24. A third sanding member 28 is configured with a dovetail-shape channel 30 corresponding to the dovetail-shape of the second sanding member 20 such that the channel 30 in the third sanding member 28 is configured to receive the second sanding member 20 and to cover the second vinyl backing layer 26 when the third sanding member 28 is removably coupled to the second sanding member 20. The third sanding member 28 includes a third sanding surface 32 covered by a vinyl backing layer 34. As seen best in FIG. 1A, a layer of pressure sensitive adhesive (PSA) 36 is applied to an upper surface of a sanding material 38. The PSA layer 36 frictionally adheres well to the vinyl backing layer 34, but may be easily peeled away for replacement of the sanding material 38. The vinyl backing layer 34 and the PSA layer 36 thus permit the removable attachment of the sanding material 38 to the third sanding surface 32. The sanding member 28 also includes a curved end portion 40 and an angled end portion 42. The vinyl backing layer 34 runs along a substantially planar bottom surface of the third sanding surface 32 and also runs upwardly along the entire length of curved and angled end portions 40 and 42, respectively.

The handle 12 of the sanding tool 10 may also include first and second auxiliary members 44 and 46 secured on opposite ends for enabling removable and replaceable attachment of sanding materials 48, 50, respectively. First auxiliary member 44 includes a circular sanding face 52 having a compressible foam member 54 of similar shape and size attached thereto such as by permanent adhesive. A vinyl backing layer 56 corresponding to the size and shape of the foam member 54 is attached such as by adhesive, to the exterior of the foam member 54. A pressure sensitive adhesive (PSA) 58 may be applied to an inner surface of sanding material 48. Handle 12 is configured with three tapered surfaces 60 (FIG. 3) so that second auxiliary member 46 includes a triangularly-shaped face 62 having a compressible foam member 64 of similar shape and size attached thereto, such as by permanent adhesive. A vinyl backing layer 66 corresponding to the size and shape of the foam member 64 is attached, such as by adhesive, to the exterior of the foam member 64. A pressure sensitive adhesive (PSA) 68 may be applied to the inner surface of sanding material 50. As explained above, the PSA layers 58, 68 will adhere to the respective vinyl backing layers 56, 66 but may be easily peeled away for selective replacement of the respective sanding materials 48, 50.

It should be noted that the handle 12 of the sanding tool 10, as well as the first, second and third sanding members 14, 20, 28 respectively, can be constructed from a variety of materials. In the preferred embodiment, sanding tool 10 is formed from a somewhat compressible material such as natural or synthetic rubber. Rubber materials of varying compressibility (durometer) may be used. It should also be understood that the sanding tool 10 may include more than three sanding members 14, 20, 28 of the preferred embodiment.

The sanding tool 10 in FIG. 1 is shown such that the second sanding member 20 and the third sanding member 28 are not coupled to the first sanding member 14 and the handle 12 in operation. Such a configuration would allow a user of the sanding tool 10 desiring to perform finishing and sanding work to grip the handle 12 and utilize only the first sanding member 14 which can be covered by a sanding material 70 having a pressure sensitive adhesive (PSA) 72 that will removably adhere to the vinyl backing layer 18. The user of the sanding tool 10 would also be able to utilize the auxiliary sanding members 44 and 46 and auxiliary sanding members 48 and 50 if the sanding tool were so equipped. If the user of the sanding tool 10 required a larger sanding surface or additional angles in order to complete the sanding or finishing work, then the user could couple the second sanding member 20 to the first sanding member 14 by sliding the first sanding member 14 into the channel 22 of the second sanding member 20. The user of the sanding tool 10 would then be able to utilize the second sanding surface 24 after covering the vinyl backing layer 26 with a sanding material 74 having a pressure sensitive adhesive (PSA) 76 that will removably adhere to the vinyl backing layer 26. In the preferred embodiment, the sanding material 70 would need to be peelably removed from the vinyl backing layer 18 of the first sanding member 14 prior to inserting the first sanding member 14 into the channel 22 of the second sanding member 20.

Still referring to FIG. 1, a user of the sanding tool 10 may also removably couple the third sanding member 28 to the second sanding member 20, the third sanding member 28 having the third sanding surface 32 covered by the third sanding material 38. In the preferred embodiment, the third sanding member 28 is the last sanding member available to couple the sanding tool 10. This is evident as the third sanding member 28 includes the curved end portion 40 and the angled end portion 42. It should be noted that the angled end portion 42 and the curved end portion 40 are part of the third sanding surface 32 and can be configured in different shapes and angles to accommodate the user.

Figure 2:
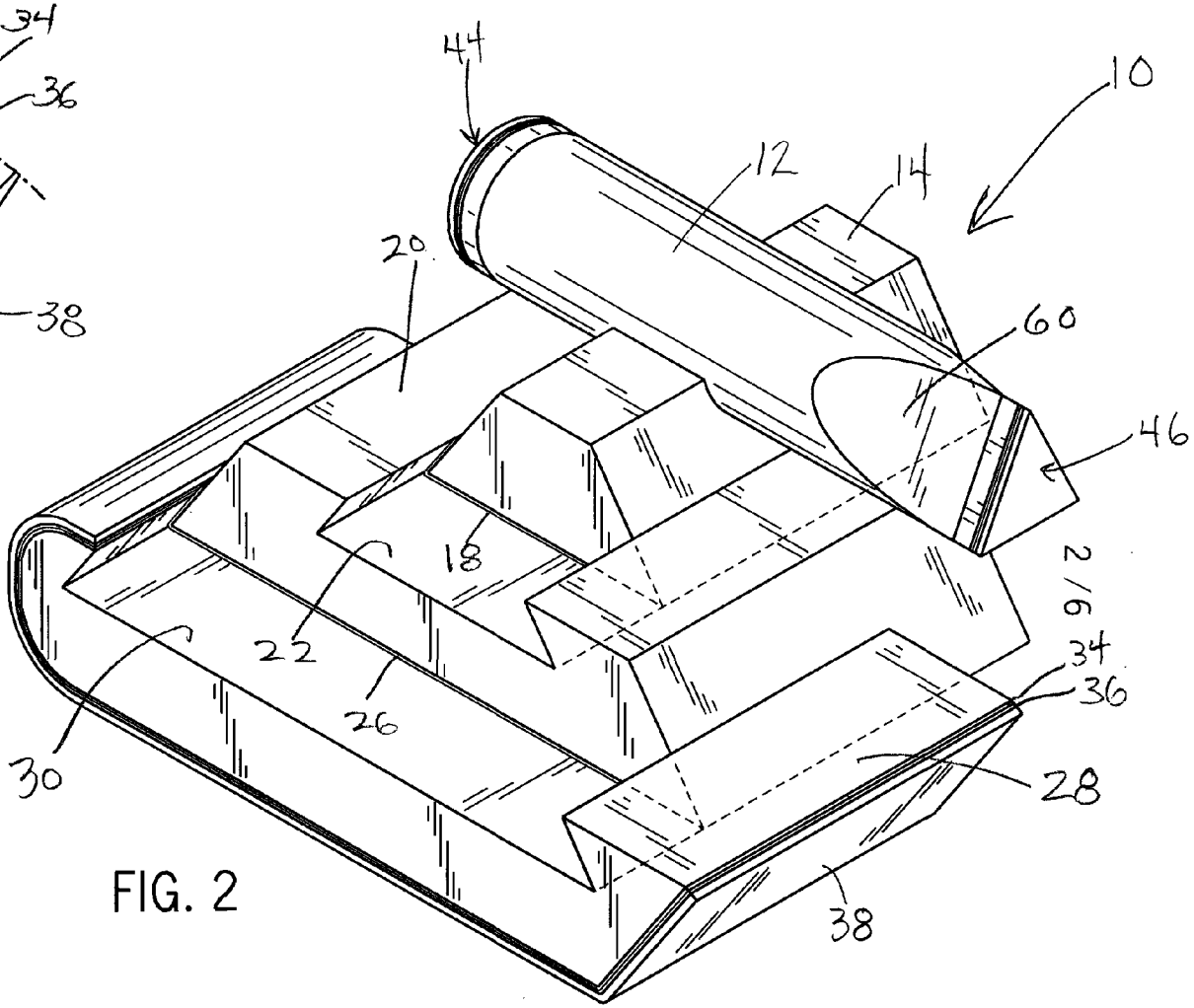
FIG. 2 illustrates a partially assembled perspective view of the embodiment of the present invention shown in FIG. 1.

FIG. 2 depicts a perspective view of the sanding tool 10 of the present invention. This view is intended to show how the sanding members 14, 20, 28 are configured to removably couple to and uncouple from each other. It should be understood that the sanding tool 10 as depicted in FIG. 2 is not necessarily ideally configured for sanding and/or finishing. Rather this figure is intended to show how the sanding members 14, 20, 28 are coupled together. Still referring to FIG. 2, the first and second auxiliary sanding members 44 and 46 and the respective auxiliary sanding faces 52 and 62 are constructed in respective circular and triangular shapes. While these shapes are advantageous for sanding and/or finishing in corners, it is contemplated that alternative embodiments can include any other shapes the user may find helpful for sanding and/or finishing.

Figure 3:
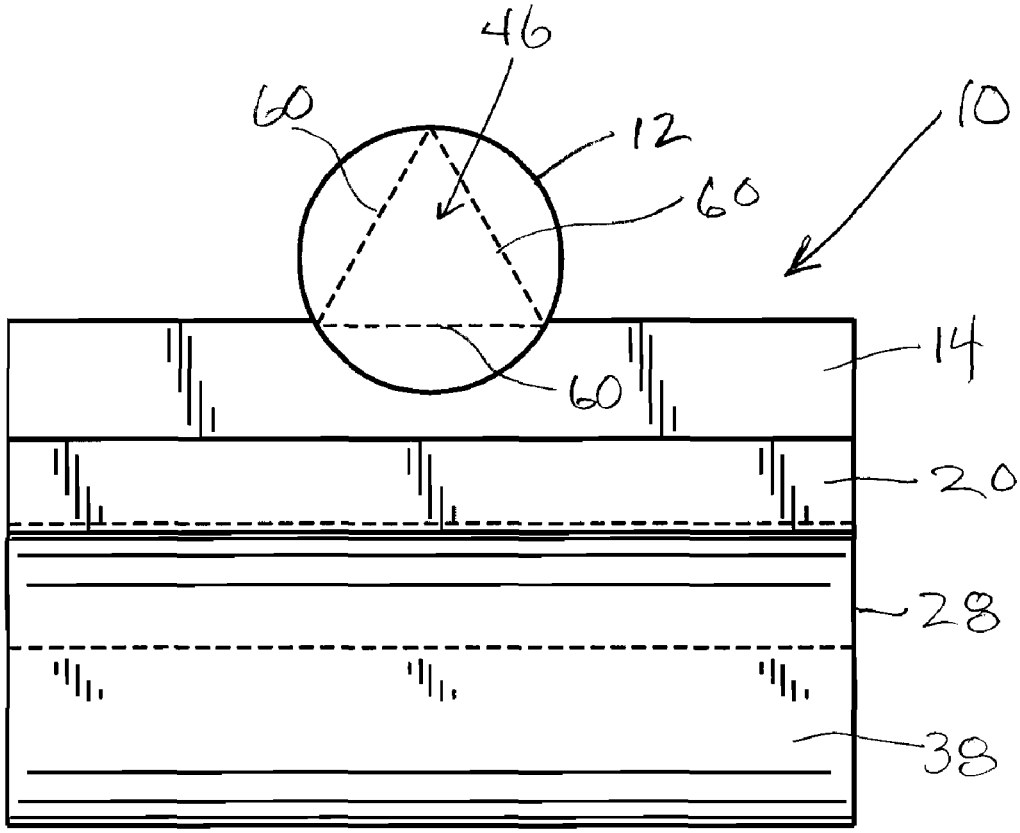
FIG. 3 illustrates a front view of the embodiment of the present invention shown in FIGS. 1 and 2.

FIG. 3 depicts a front view of the sanding tool 10 of the present invention. Here the sanding members 14, 20, 28 are coupled together such that a user of the tool 10 would grip the handle 12 and utilize the third sanding member 28 and the third sanding material 38. Of course, the user of the sanding tool 10 could also utilize the curved and angled end portions 40 and 42 covered by sanding material 38 to sand and/or finish.

Figure 4:
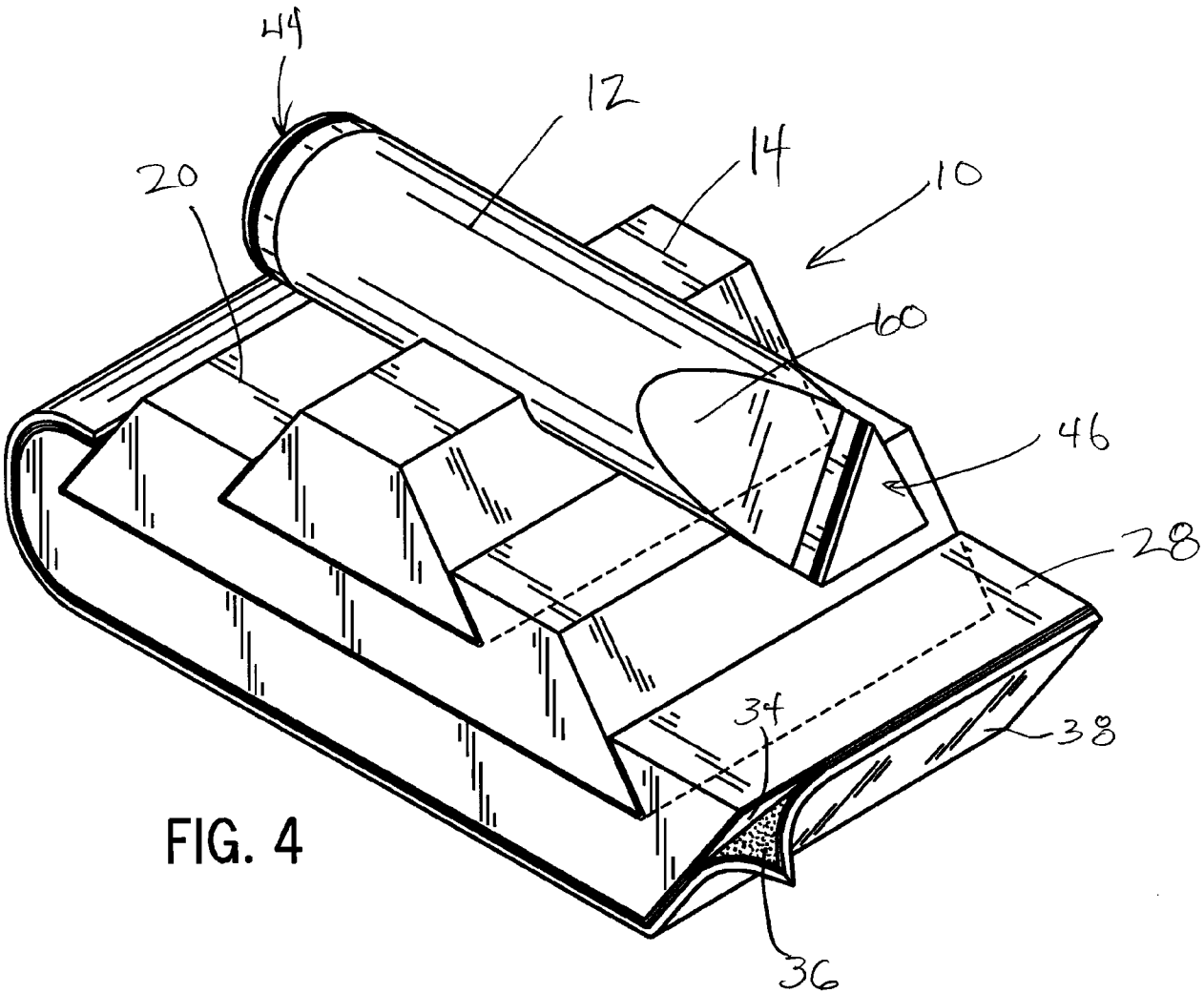
FIG. 4 illustrates a fully assembled perspective view of the embodiment of the present invention shown in FIGS. 1-3.

FIG. 4 depicts a perspective view of the fully assembled sanding tool 10. This figure is intended to illustrate how the first vinyl covered sanding surface 16 of first sanding member 14 fits into channel 22 of the second sanding member 20, and how the second vinyl cover sanding surface 24 of the second sanding member 20 fits into the channel 30 of the third sanding member 28 which is equipped with sanding material 38. It should be understood that any of the sanding surfaces described above in the present invention have a sanding material fixed to the sanding surface before sanding and/or finishing can be performed with individual members 14, 20, 28.

Figure 5:
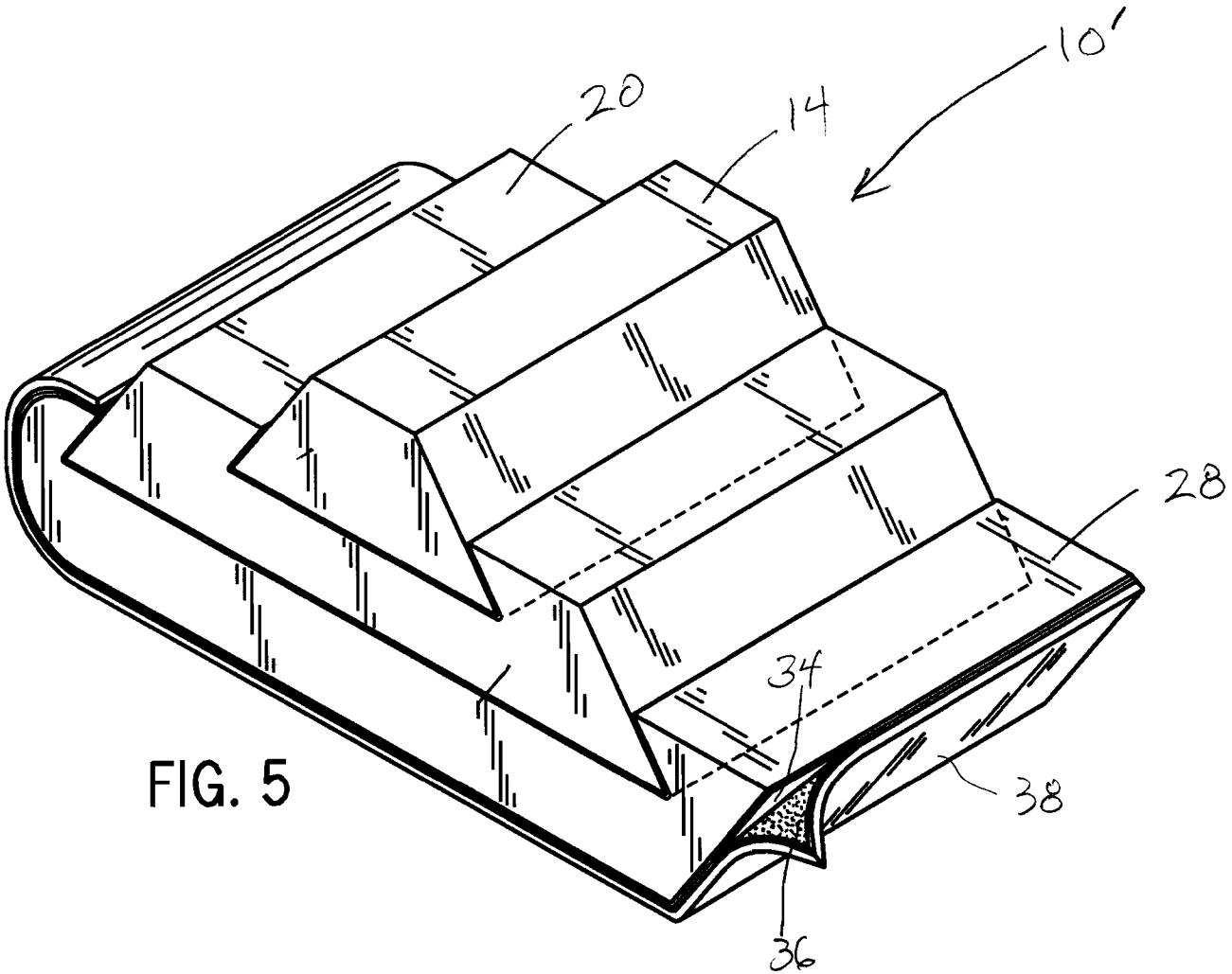
FIG. 5 is a fully assembled perspective view of an alternative embodiment of the invention.

FIG. 5 is a view similar to FIG. 4 which illustrates a sanding tool 10 having the cylindrical handle 12 deleted. In using the tool 10, a user will simply grasp the opposite sides of the first sanding member 14 which define a handle. If desired, the first sanding member 14 in FIG. 5, can be removed so that the interlocked second and third sanding members 20, 28 respectively, can be used for sanding. In this case, the sides of the second sanding member 20 define the handle.

Figure 6:
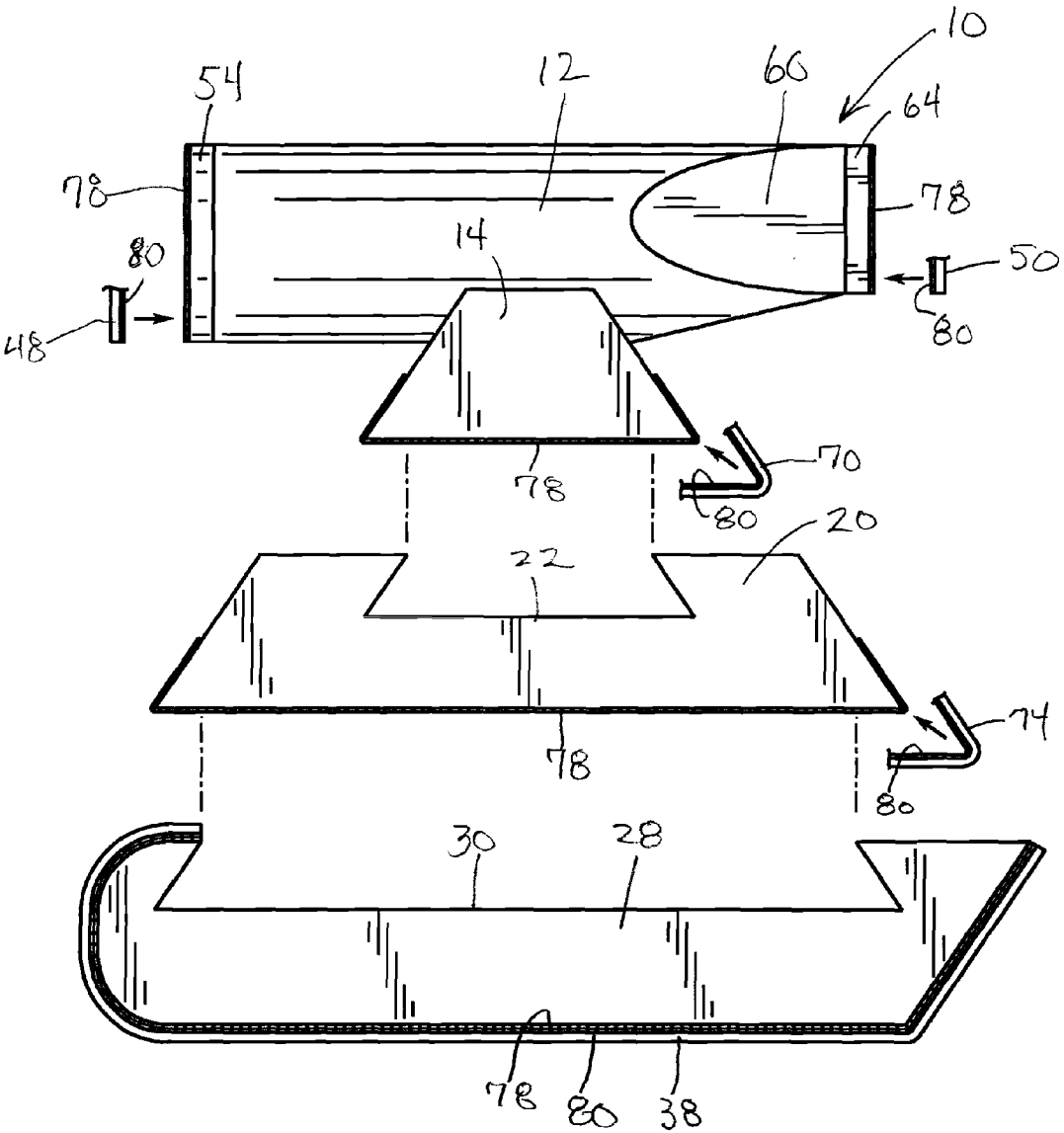
FIG. 6 is a view similar to FIG. 1 showing an alternative means for removably attaching sanding material to the sanding surfaces.

FIG. 6 illustrates an alternative embodiment of the invention which shows an alternative means of removably attaching the sanding materials 70, 74, 38 to the respective sanding members 14, 20, 28. In this version, any of the respective sanding surfaces 16, 24, 32 can be adhesively covered with one type of a hook and loop fastener 78 (e.g. Velcro). A cooperating hook and loop fastener 80 is attached such as by adhesive to the back face of sanding materials 70, 74, 38 respectively. In a similar manner, the foam materials 54, 64 on the opposite ends of the handle 12 can be adhesively covered with hook and loop fastener 78 to cooperate with hook and loop fasteners 80 secured on the sanding materials 48 and 50 so that the sanding materials 48 and 50 may be easily removed or replaced if desired. The present invention thus discloses two separate embodiments for temporarily affixing sanding materials to various sanding surfaces.

The present invention has been described in terms of specific embodiments incorporating details to facilitate the understanding of the principles of the construction and operation of the invention. Such references herein to specific embodiments and details thereof is not intended to limit the scope of the claims appended hereto. It will be apparent to those skilled in the art that modifications may be made in the embodiment chosen for illustration without departing from the spirit and scope of the invention.

I claim:

1. A sanding apparatus comprising:

a first sanding member including a first sanding surface configured for sanding variously shaped surfaces, the first sanding member being formed with a handle; and a second sanding member having a second sanding surface and a channel for receipt of the first sanding member such that the second sanding member is removably attached to the first sanding member wherein, when the first and second sanding members are attached, the second sanding member substantially covers the first sanding surface; wherein:

a second sanding material is affixed to the second sanding surface such that the second sanding material substantially cover the second standing surface;

when the first and second sanding members are uncoupled, a first sanding material is affixed to the first sanding surface such that the first sanding material substantially cover the first sanding surface;

either of the first sanding material or the second sanding material is removably affixed to the first sanding surface or the second sanding surface, respectively; and, the first sanding material is removed from the first sanding surface before the first sanding member is coupled to the second sanding member.

2. The apparatus of claim 1, wherein the first sanding surface and the second sanding surface are covered with a vinyl backing layer.

3. The apparatus of claim 2, wherein a surface of the second sanding material is provided with a pressure sensitive adhesive which is removably joined to the vinyl backing layer on the first sanding surface.

4. The apparatus of claim 2, wherein a surface of the second sanding material is provided with a pressure sensitive adhesive which is removably joined to the vinyl backing layer on the second sanding surface.

5. The apparatus of claim 1, wherein the first sanding surface and the second sanding surface are covered with one half of a hook and loop fastener.

6. The apparatus of claim 5, wherein a surface of the first sanding material is provided with the other half of a hook and loop fastener which is removably joined to the one half of a hook and loop fastener on the first sanding surface.

7. The apparatus of claim 5, wherein a surface of the second sanding material is provided with the other half of a hook and loop fastener which is removably joined to the one half of a hook and loop fastener on the second sanding surface.

8. The apparatus of claim 1, wherein the handle has a substantially cylindrical shape.

9. The apparatus of claim 8, further comprising an auxiliary sanding member coupled to the handle, wherein the auxiliary sanding member includes an auxiliary sanding surface configured to receive an auxiliary sanding material.

10. The apparatus of claim 9, wherein the auxiliary sanding member is constructed such that the outside auxiliary sanding surface is circular in shape.

11. The apparatus of claim 9, wherein the auxiliary sanding member is constructed such that the auxiliary sanding surface is triangular in shape.

12. The apparatus of claim 1, wherein any of the handle, the first sanding member and the second sanding member are constructed from a rubber material.

13. The apparatus of claim 9, wherein the auxiliary sanding member includes a compressible foam material.

14. The apparatus of claim 1, wherein the apparatus includes a third sanding member having a third sanding surface, the third sanding member configured to be removably coupled to the second sanding member such that a channel in the third sanding member is constructed to receive the second sanding member, wherein, when the second sanding member and the third sanding member are coupled, the third sanding member substantially covers the second sanding surface.

15. The apparatus of claim 14, wherein a third sanding material is removably affixed to the third sanding surface.

16. The apparatus of claim 14, wherein the third sanding surface is covered with a vinyl backing layer.

17. The apparatus of claim 16, wherein a surface of the third sanding material is provided with a pressure sensitive adhesive which is removably joined to the vinyl backing layer on the third sanding surface.

18. The apparatus of claim 14, wherein the first sanding surface, the second sanding surface and the third sanding surface are substantially planar.

19. A hand tool for sanding and finishing comprising:

a first sanding member including a first sanding surface configured for sanding variously shaped surfaces, the first sanding member defining a handle;

a second sanding member having a second sanding surface and a channel for receipt of the first sanding member such that the second sanding member is removably attached to the first sanding member wherein, when the first and second sanding members are attached, the second sanding member substantially covers the first sanding surface; and a third sanding member having a third sanding surface and a channel for receipt of the second sanding member such that the third sanding member is removably attached to the second sanding member, wherein, when the second and third sanding members are attached, the third sanding member substantially covers the second sanding surface, the third sanding surface being provided with a sanding material affixed thereto.

20. The hand tool of claim 19, wherein, when the first and second sanding members are uncoupled, a first sanding material is affixed to the first sanding surface such that the first sanding material substantially covers the first sanding surface.

21. The hand tool of claim 19, wherein, the third sanding material is affixed to the third sanding surface such that the third sanding material substantially covers the third sanding surface.

22. The hand tool of claim 19, wherein the first and second sanding members have substantially planar bottoms and inwardly sloping opposite end portions.

23. The hand tool of claim 19, wherein the third sanding member has a substantially planar bottom, a rounded end portion and an angled end portion.

* * * * *